US010233726B2

(12) United States Patent
He et al.

(10) Patent No.: US 10,233,726 B2
(45) Date of Patent: Mar. 19, 2019

(54) PRESSURE DIFFERENTIAL DEVICE WITH CONSTANT PRESSURE DROP

(71) Applicants: Zhi Y. He, Cypress, TX (US); Madhawa Ratnayake, Houston, TX (US); Kun Yuan, Houston, TX (US); Carlos P. Izaguirre, Houston, TX (US); David Teale, Spring, TX (US); Darrin L. Willauer, The Woodlands, TX (US)

(72) Inventors: Zhi Y. He, Cypress, TX (US); Madhawa Ratnayake, Houston, TX (US); Kun Yuan, Houston, TX (US); Carlos P. Izaguirre, Houston, TX (US); David Teale, Spring, TX (US); Darrin L. Willauer, The Woodlands, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 612 days.

(21) Appl. No.: 14/466,076

(22) Filed: Aug. 22, 2014

(65) Prior Publication Data

US 2016/0053577 A1 Feb. 25, 2016

(51) Int. Cl.

| | |
|---|---|
| ***E21B 34/10*** | (2006.01) |
| ***E21B 43/12*** | (2006.01) |
| *E21B 41/00* | (2006.01) |

(52) U.S. Cl.

CPC ..... *E21B 34/101* (2013.01); *E21B 34/10* (2013.01); *E21B 34/102* (2013.01); *E21B 43/12* (2013.01); *E21B 41/00* (2013.01)

(58) Field of Classification Search

CPC ..... E21B 34/101; E21B 34/10; E21B 43/12; E21B 34/102

See application file for complete search history.

(56) References Cited

U.S. PATENT DOCUMENTS

| | | | | | |
|---|---|---|---|---|---|
| 3,485,474 | A * | 12/1969 | Baumann | F16K 1/54 | 251/121 |
| 3,693,732 | A * | 9/1972 | Sabi | E21B 21/08 | 166/91.1 |
| 3,715,098 | A * | 2/1973 | Baumann | F16K 47/04 | 251/121 |
| 3,880,399 | A * | 4/1975 | Luthe | F16K 47/02 | 137/625.37 |
| 4,044,834 | A * | 8/1977 | Perkins | E21B 21/08 | 166/370 |
| 5,123,436 | A * | 6/1992 | Koechlein | G05D 16/0666 | 137/12 |
| 7,419,002 | B2 * | 9/2008 | Dybevik | E21B 43/12 | 166/169 |

(Continued)

*Primary Examiner* — Nicole Coy

(74) *Attorney, Agent, or Firm* — Cantor Colburn LLP

(57) ABSTRACT

In one aspect, an apparatus for use in a wellbore is disclosed, including: an inlet; an outlet; and a variable flow restriction configured to provide a predetermined constant pressure drop between the inlet and the outlet in response to a range of inlet flow rates. In another aspect, a method for providing a fluid flow within a wellbore is disclosed, including: providing the fluid flow to an inlet; restricting the fluid flow to provide a predetermined constant pressure drop between the inlet and an outlet in response to a range of fluid flow rates; and providing the fluid flow to the wellbore from the outlet.

17 Claims, 3 Drawing Sheets

(56) References Cited

U.S. PATENT DOCUMENTS

| | | | | |
|---|---|---|---|---|
| 8,069,921 | B2 * | 12/2011 | Garcia | E21B 34/08 166/236 |
| 8,403,038 | B2 * | 3/2013 | Russell | E21B 43/12 166/205 |
| 8,403,061 | B2 * | 3/2013 | Russell | E21B 43/12 166/369 |
| 8,833,466 | B2 * | 9/2014 | Zhou | E21B 34/08 166/319 |
| 2013/0019673 | A1 * | 1/2013 | Sroka | E21B 49/08 73/152.55 |
| 2013/0068467 | A1 * | 3/2013 | Zhou | E21B 34/08 166/369 |

* cited by examiner

PRESSURE DIFFERENTIAL DEVICE WITH CONSTANT PRESSURE DROP

BACKGROUND

1. Field of the Disclosure

This disclosure relates generally to pressure differential devices that facilitate constant pressure differentials across a range of flow rates.

2. Background

Wellbores are drilled in subsurface formations for the production of hydrocarbons (oil and gas). During wellbore operations it is often desired to inject chemicals to downhole locations to prevent corrosion, remove debris, facilitate production, etc. Chemical pumps may experience pump surges due to change in backpressure and other conditions, decreasing pump lifecycle. During chemical injection operations, it is often desired to maintain a constant backpressure for the chemical inlet flow, particularly across flow rates.

The disclosure herein provides a pressure differential device that facilitates constant pressure differentials across a range of flow rates.

SUMMARY

In one aspect, an apparatus for use in a wellbore is disclosed, including: an inlet; an outlet; and a variable flow restriction configured to provide a predetermined constant pressure drop between the inlet and the outlet in response to a range of inlet flow rates.

In another aspect, a system for use in a wellbore is disclosed, including a pump with a fluid flow, a tubular associated with the fluid flow; and a pressure differential device associated with the tubular including: an inlet associated with the fluid flow; an outlet; and a variable flow restriction configured to provide a predetermined constant pressure drop between the inlet and the outlet in response to a range of inlet flow rates.

In another aspect, a method for providing a fluid flow within a wellbore is disclosed, including: providing the fluid flow to an inlet; restricting the fluid flow to provide a predetermined constant pressure drop between the inlet and an outlet in response to a range of fluid flow rates; and providing the fluid flow to the wellbore from the outlet.

Examples of the more important features of certain embodiments and methods have been summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements are generally given same numerals and wherein.

DETAILED DESCRIPTION OF THE DRAWINGS

Figure 1:
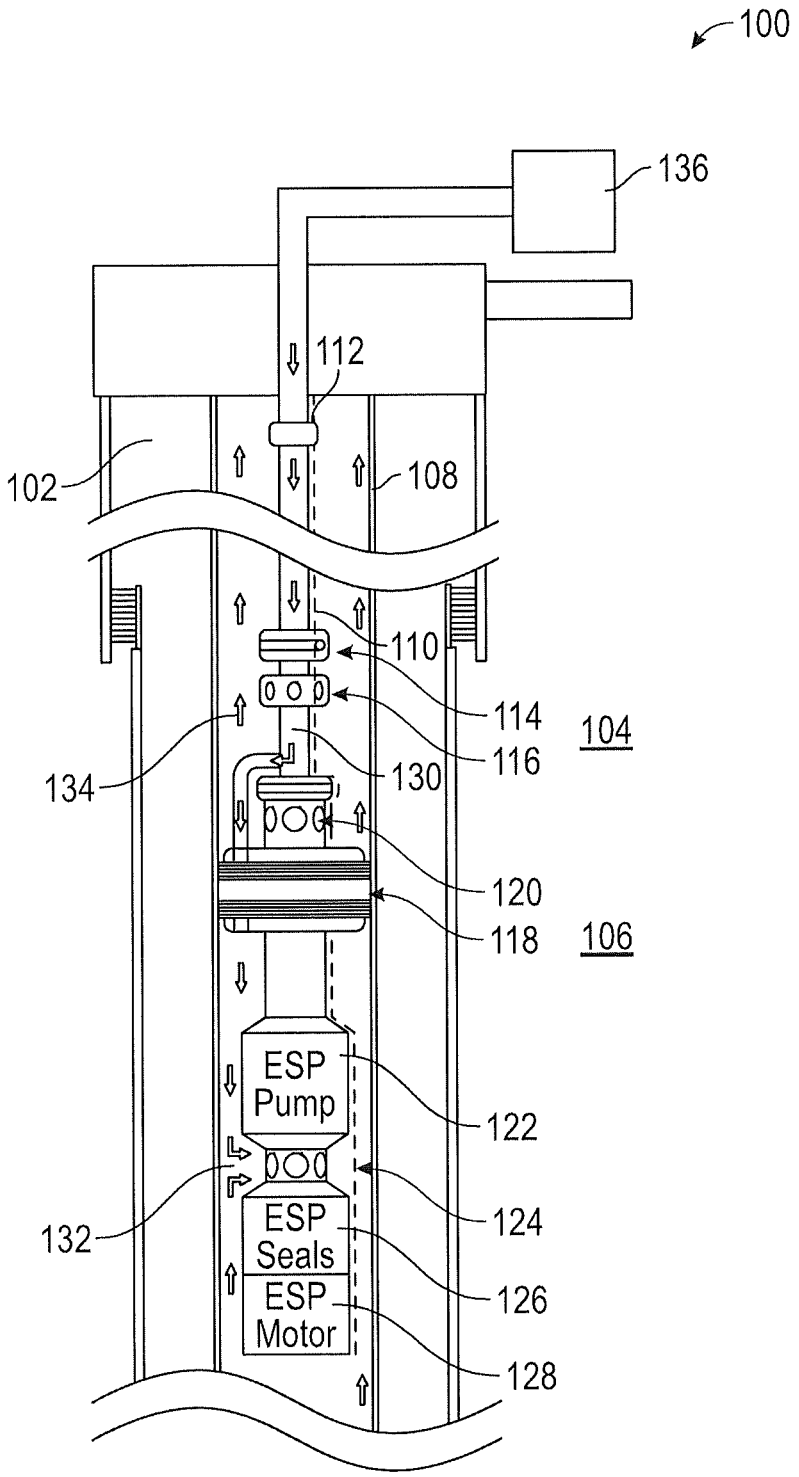
FIG. 1 shows an exemplary wellbore system that includes a pressure differential device, according to one non-limiting embodiment of the disclosure.

FIG. 1 is a line diagram of a wellbore system 100 for the production of formation fluids from a well. The assembly 100 is shown to include a casing 108 deployed in wellbore 102 formed in a formation 104. Tubing 110 is deployed within the casing 108 from a surface location to a downhole location 106. Chemicals utilized during wellbore operations are supplied into tubing 110. In an exemplary embodiment, tubing 110 supplies a chemical fluid flow 130 from pump 136 to a downhole location 106.

Tubing string 110 may include an orienting sub 112 and tubing disconnect 116. In an exemplary embodiment, tubing string 110 is associated with an electrical submersible pump 122 to facilitate production of formation fluids. In certain embodiments, tubing string 110 is associated with electrical submersible pump 122 via tubing disconnect 116. Packer 118 may be set to isolate a production zone from other portions of formation 104.

In an exemplary embodiment, chemical fluid flow 130 passes through packer 118 to be received in a production zone where ESP (electrical submersible pump) pump 122 is located. In other embodiments, chemical fluid flow 130 flows to a general downhole location 106. Such chemicals may include anti-corrosive chemicals, chemicals to remove debris, diluents, etc. In an exemplary embodiment, chemical fluid flow 130 includes diluent to mix with formation fluid to allow for a lower viscosity flow of formation fluid 134 to facilitate efficient pumping of formation fluid 134 to the surface via ESP pump 122. The use of diluent allows more efficiency in lifting operations and creates a more desirable resulting product. The ESP system includes ESP pump 122, ESP cable 124, ESP seals 126 and ESP motor 128. The ESP pump 122 receives formation fluid flow 134 and chemical flow 130 at an ESP inlet 132. Chemical flow 130 may interact with formation fluid flow 134 to allow for the formation fluid flow 134 to be pumped. ESP discharge 120 allows for formation fluid flow 134 to be returned to the surface.

As chemical flow 130 is pumped from the surface the chemical flow 130 rate may vary. In order to provide a constant back pressure as flow rates vary pressure differential device 114 is utilized to facilitate a backpressure within tubing 110 and against pump 136. A non-limiting embodiment of a pressure differential device 114 is described in reference to FIGS. 2A-2D.

FIGS. 2A-2D shows a non-limiting embodiment of a pressure differential device for use in a wellbore system, including the wellbore system shown in FIG. 1, for deployment in a wellbore, such as wellbore shown in FIG. 1. The pressure differential device 214 includes a body 240, an uphole connection or inlet 242 to receive flow from tubing 110 and an outlet 282. In an exemplary embodiment, pressure differential device 214 includes disks 244 disposed within bores 248, connected by a shaft 246, wherein the shaft 246 is urged by power spring 264. Pressure differential device 214 further includes a locking mechanism 250 and a damping mechanism 280.

Figure 2A:
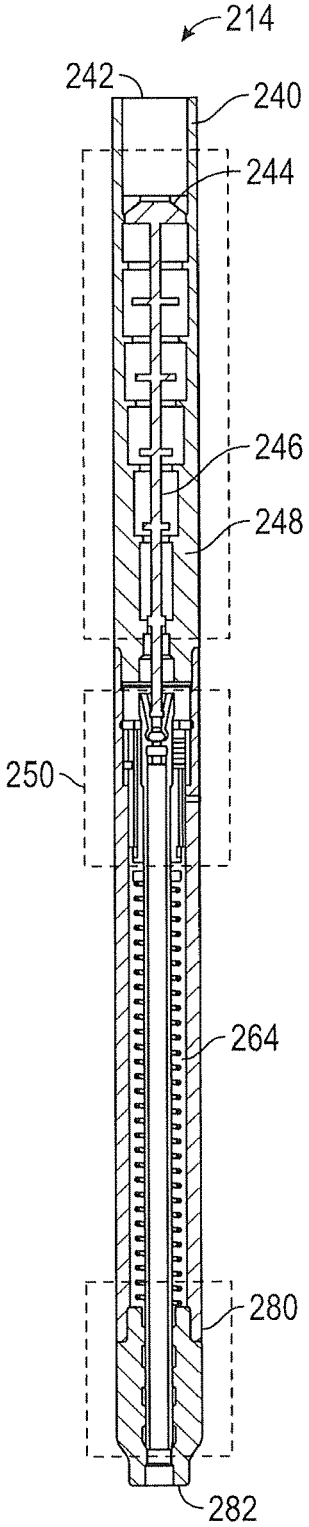
FIG. 2A shows a non-limiting embodiment of a pressure differential device for use in a wellbore system, including the wellbore system shown in FIG. 1, for deployment in a wellbore, such as wellbore shown in FIG. 1.
Figure 2B:
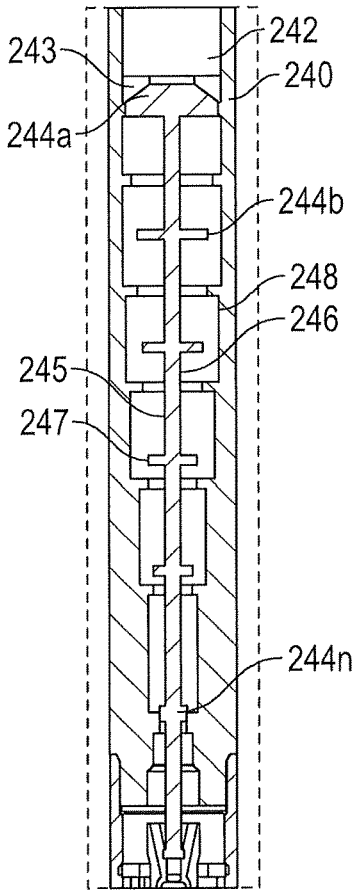
FIG. 2B shows a partial cross-section view of the pressure differential device shown in FIG. 2.

Referring now to FIG. 2B, a partial cross sectional view of the pressure differential device 214 is shown. The chemical flow 130 is received in inlet 242. The pressure differential device includes a variable flow restriction between the inlet and outlet. In an exemplary embodiment, the variable flow restriction is configured to provide a constant pressure drop between the inlet and outlet in response to a range of inlet flow rates. In certain embodiments the range of inlet flow rates include between 10-100 gallons per minute, while in other embodiments the range may include lower or higher flow rates, or larger or smaller ranges of flow rates.

In an exemplary embodiment, a plurality of disks 244*a*-244*n* are disposed within a plurality of bores 248 to create a plurality of flow restrictions. In an exemplary embodiment, the disks 244*a*-244*n* are mechanically coupled via shaft 246 that allows the disks 244*a*-244*n* to move together. Accordingly, the disks 244*a*-244*n* may cooperatively provide a constant pressure drop across device 214 for a range of flow rates.

In an exemplary embodiment, disks 244*a*-244*n* are arranged to have decreasing outside diameters as flow 130 flows from an inlet 242 to an outlet 282. Accordingly, a first disk 244*a* may have the largest outside diameter while a last disk 244*n* may have the smallest outside diameter.

Disks 244*a*-244*n* are disposed within bores 248 to cooperatively provide flow restrictions. Each bore 248 includes a bore inlet 245 and a bore outlet 247 wherein disks 244*a*-244*n* may translate therebetween. In an exemplary embodiment, the bores 248 are configured wherein the bores 248 housing larger disks 244*a*-244*n* have a respective larger bore inner diameter. Further, in certain embodiments, the bores 248 are configured to provide a larger difference in diameter between the outside diameter of disks 244*a*-244*n* and the inner diameter of bores 248 for larger disks 244*a*-244*n*. For example, the difference between the outside diameter of disk 244*a* and respective inner diameter of bore 248 is larger than the difference between the outside diameter of disk 244*n* and inner diameter of respective bore 248.

In an exemplary embodiment, disks 244*a*-244*n* are upwardly urged by a power spring 264. Power spring 264 may impart force upon shaft 246 to provide a desired flow restriction in response to a fluid flow. The force of power spring 264 may be selected in response to several design parameters. In an exemplary embodiment, upper disk 244*a* is urged upward to have a sealing relationship with an inlet interface 243 of its respective bore 248 during a no flow condition.

In order to determine the desired design parameters of disks 244*a*-244*n*, respective bores 248, and the relative position of disks 244*a*-244*n* along shaft 246, the desired operating parameters are analyzed and correlated to the design parameters. First, for each disk 244*a*-244*n* and respective bore 248 a target flow rate is decided that provides a desired pressure drop at a target flow rate. Next a flow rate range is determined wherein both the minimum and maximum flow rates generate a similar relative error based on the design calculation. This correlation may contemplate bore 248 inner diameter, disk 244*a*-244*n* outer diameter, fluid density, flow rate, etc.

The pressure drop from each disk 244*a*-244*n* and respective bore is estimated from annular orifice correlation and the respective pressure drops are added to get a total pressure drop across pressure differential device 214. Accordingly, the design dimensions are iteratively modified as necessary to achieve the desired pressure drop across a desired flow rate range for pressure differential device 214. Table 1 below lists an exemplary flow rate range and target flow rate for an exemplary embodiment of differential device 214 including 6 disks.

TABLE 1

| | Min Rate (gpm) | Max Rate (gpm) | Target Flow Rate (gpm) |
|---|---|---|---|
| Position 1 | 10 | 14.4 | 12 |
| Position 2 | 14.4 | 20.8 | 17.3 |
| Position 3 | 20.8 | 30 | 25 |
| Position 4 | 30 | 43.3 | 36 |
| Position 5 | 43.3 | 62.4 | 52 |
| Position 6 | 62.4 | 90 | 75 |

Table 2 below lists an exemplary pressure drop in response to several flow rates for an exemplary embodiment of differential device 214 including 6 disks. As shown, the embodiments described maintain a generally constant pressure drop at various target flow rates by utilizing the plurality of disks 244-244*n*.

TABLE 2

| Flow Rate | ΔP (psi) | | | | | |
|---|---|---|---|---|---|---|
| (gpm) | Disk 1 | Disk 2 | Disk 3 | Disk 4 | Disk 5 | Disk 6 |
| 12 | 532.125 | 0.589 | 0.0726 | 0.03 | 0.027 | 0.038 |
| 17.3 | 1.11 | 546.38 | 0.151 | 0.0618 | 0.056 | 0.079 |
| 25 | 2.32 | 4.06 | 564.768 | 0.129 | 0.117 | 0.263 |
| 36 | 4.84 | 5.296 | 0.654 | 572.602 | 0.242 | 0.343 |
| 52 | 10.04 | 11.05 | 1.36 | 0.559 | 554.63 | 0.716 |
| 75 | 20.88 | 22.988 | 2.837 | 1.162 | 1.051 | 565.659 |
| Total ΔP (psi) | 571.285 | 590.363 | 569.8426 | 574.5438 | 556.123 | 567.098 |

In an exemplary embodiment, at each target flow rate, one disk 244*a*-244*n* and a respective bore 248 are designed to provide a significant portion of the primary pressure drop. In certain embodiments, one disk 244*a*-244*n* and a respective bore 248 are designed to provide a target pressure drop at a respective flow rate. In certain embodiments, the primary pressure drop occurs at the disk 244*a*-244*n* that has a smallest difference between the outside diameter of disk 244*a*-244*n* and respective bore 248 due to the position of shaft 246 and power spring 264.

While an embodiment with 6 disks has been described above, other embodiments may include a greater or fewer number of disks. It may be appreciated that the inclusion of a greater number of adjustable flow restrictions or disks may decrease the overall error with respect to the overall change in pressure.

Advantageously, a constant pressure drop minimizes pump surge due to changes in fluid flow, environmental conditions, fluid properties, etc.

Figure 2C:
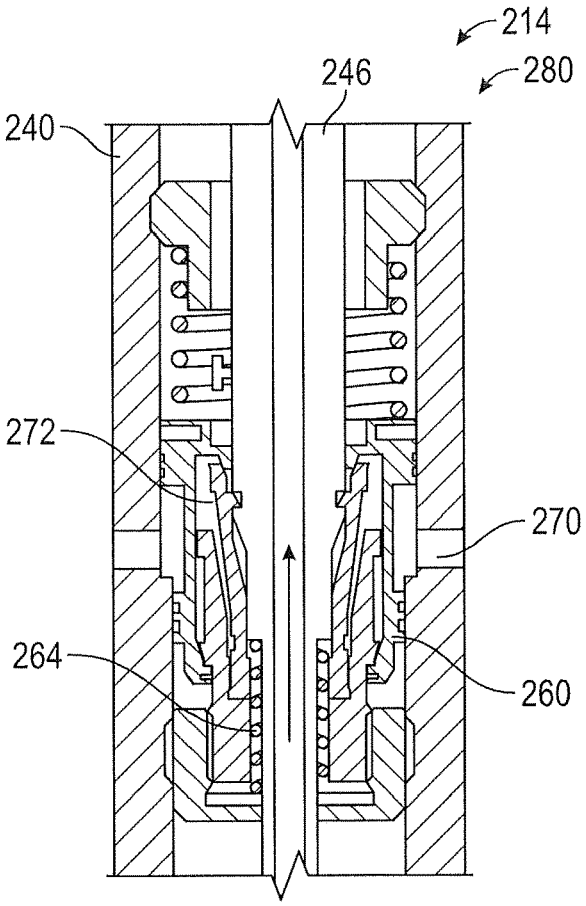
FIG. 2C shows another partial cross-section view of the pressure differential device shown in FIG. 2.

Referring now to FIG. 2C a partial cross sectional view of the pressure differential device 214 is shown, particularly the locking mechanism 250. In an exemplary embodiment, locking mechanism 250 is controlled by chemical flow 130, annular fluid pressure or a combination thereof. Locking mechanism 250 allows for two modes of operation. In an exemplary embodiment, locking mechanism 250 allows for shaft 246 to move freely to be urged by power spring 264 and react to a fluid flow 130 as described above when in an unlocked position. Further, locking mechanism 250 allows for shaft 246 to be placed in a locked position wherein the fluid restrictions described above are minimized to allow high fluid flow rate with minimal pressure drop.

In an exemplary embodiment, shaft 246 is placed in a locked position by being pushed downward by imparting a higher than normal operating flow rate upon disks 244*a*-

244*n*. It may be appreciated that such a flow rate may be determined by using the analysis provided above and exceeding the designed normal fluid flow rate range. After the shaft 246 is urged downward beyond normal operating position split latch 272 will lock shaft 246 into place. To release the locked shaft 246 annular pressure is applied through port 270 to urge sliding sleeve 260 upward. Accordingly, this releases the split latch 272 and allows shaft 246 and disks 244*a*-244*n* to move freely as described above.

Figure 2D:
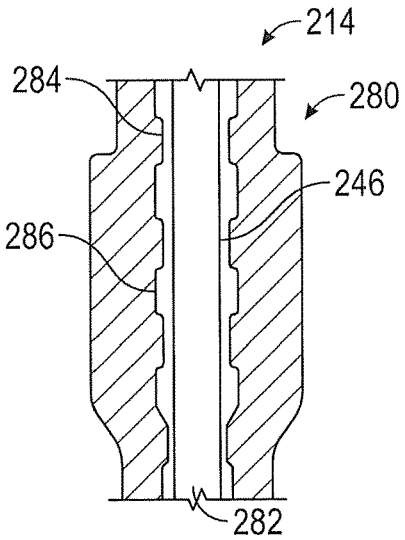
FIG. 2D shows another partial cross-section view of the pressure differential device shown in FIG. 2.

Referring now to FIG. 2D a partial cross sectional view of the pressure differential device 214 is shown, particularly the damping mechanism 280. During operation shaft 246 may move quickly and often in response to fluid flow changes. In order to prevent unwanted oscillations, damping mechanism 280 may filter such movements. In an exemplary embodiment, raised portions 284, and lower portions 286 in conjunction with a fluid flow 130 may filter oscillations of shaft 246 removing extraneous and transient oscillations.

Therefore in one aspect, the present disclosure provides an apparatus for use in a wellbore, including: an inlet; an outlet; and a variable flow restriction configured to provide a predetermined constant pressure drop between the inlet and the outlet in response to a range of inlet flow rates. In certain embodiments the variable flow restriction is a plurality of associated flow restrictions. In certain embodiments the plurality of associated flow restrictions are mechanically coupled. In certain embodiments the plurality of associated flow restrictions is a plurality of associated disks. In certain embodiments the plurality of associated disks are disposed in a plurality of bores. In certain embodiments each of the plurality of associated flow restrictions is configured to provide a target pressure drop in response to each of a plurality of discrete inlet flow rates. In certain embodiments the variable flow restriction includes a damping mechanism. In certain embodiments the variable flow restriction includes a locking mechanism configured to lock the variable flow restriction in a locked position to provide a minimal flow restriction between the inlet and the outlet.

In another aspect, the present disclosure provides a system for use in a wellbore, including a pump with a fluid flow a tubular associated with the fluid flow; and a pressure differential device associated with the tubular including: an inlet associated with the fluid flow; an outlet; and a variable flow restriction configured to provide a predetermined constant pressure drop between the inlet and the outlet in response to a range of inlet flow rates. In certain embodiments the variable flow restriction is a plurality of associated flow restrictions. In certain embodiments the plurality of associated flow restrictions are mechanically coupled. In certain embodiments the plurality of associated flow restrictions is a plurality of associated disks. In certain embodiments the plurality of associated disks are disposed in a plurality of bores. In certain embodiments each of the plurality of associated flow restrictions is configured to provide a target pressure drop in response to each of a plurality of discrete inlet flow rates. In certain embodiments the variable flow restriction includes a damping mechanism. In certain embodiments the variable flow restriction includes a locking mechanism configured to lock the variable flow restriction in a locked position to provide a minimal flow restriction between the inlet and the outlet.

In another aspect, the present disclosure provides a method for providing a fluid flow within a wellbore, including: providing the fluid flow to an inlet; restricting the fluid flow to provide a predetermined constant pressure drop between the inlet and an outlet in response to a range of fluid flow rates; and providing the fluid flow to the wellbore from the outlet. In certain embodiments, the method includes providing a plurality of associated flow restrictions configured to restrict the fluid flow. In certain embodiments, the method includes mechanically coupling the plurality of associated flow restrictions. In certain embodiments, the method includes providing a target pressure drop via each of the plurality of associated flow restrictions in response to each of a plurality of discrete fluid flow rates.

The invention claimed is:

1. An apparatus for use in a wellbore, comprising:
an apparatus inlet;
an apparatus outlet:
a plurality of bones through which fluid flows between the apparatus inlet and the apparatus outlet, each of the plurality of bores having a bore outlet; and
a plurality of movable members attached along a shaft between the apparatus inlet and apparatus outlet, the plurality of movable members being associated with the plurality of bores, with each movable member being associated with a respective bore, wherein the plurality of movable members are movable to alter a variable flow restriction between the apparatus inlet and apparatus outlet to provide a predetermined constant pressure drop between the apparatus inlet and the apparatus outlet in response to a range of apparatus inlet flow rates, wherein each bore provides a different pressure drop, and a primary pressure drop occurs at the movable member having a smallest difference between an outside diameter of the movable member and its respective bore outlet due to a position of the shaft.

2. The apparatus of claim 1, wherein the variable flow restriction is a plurality of associated flow restrictions created by the plurality of movable members.

3. The apparatus of claim 2, wherein each of the plurality of associated flow restrictions is configured to provide a target pressure drop in response to each of a plurality of discrete apparatus inlet flow rates.

4. The apparatus of claim 1, wherein the plurality of movable members is a plurality of movable disks.

5. The apparatus of claim 1, wherein the plurality of bores are between the apparatus inlet and the apparatus outlet.

6. The apparatus of claim 1, wherein the variable flow restriction includes a damping mechanism that urges the plurality of movable members towards the apparatus inlet.

7. The apparatus of claim 1, further comprising a locking mechanism configured to lock the plurality of movable members in a locked position to provide a minimal flow restriction between the apparatus inlet and the apparatus outlet.

8. A system for use in a wellbore, comprising:
a pump with a fluid flow;
a tubular associated with the fluid flow; and
a pressure differential device associated with the tubular including: a device inlet associated with the fluid flow:
a device outlet;
a plurality of bores through which fluid flows between the device inlet and the device outlet, each of the plurality of bores having a bore outlet; and
a plurality of movable members attached along a shaft between the device inlet and the device outlet, the plurality of movable members being associated with the plurality of bores, with each movable member being associated with a respective bore, wherein the plurality of movable members are movable to alter a variable flow restriction between the device inlet and device outlet to provide a predetermined constant pressure drop between the device inlet and the device outlet in response to a range of device inlet flow rates, wherein each bore provides a different pressure drop, and a primary pressure drop occurs at the movable member having a smallest difference between an outside diameter of the movable member and its respective bore outlet due to a position of the shaft.

9. The system of claim 8, wherein the variable flow restriction is a plurality of associated flow restrictions created by the plurality of movable members.

10. The system of claim 9, wherein each of the plurality of associated flow restrictions is configured to provide a target pressure drop in response to each of a plurality of discrete device inlet flow rates.

11. The system of claim 8, wherein the plurality of movable members is a plurality of movable disks.

12. The system of claim 8, wherein the plurality of bores are between the device inlet and the device outlet.

13. The system of claim 8, wherein the variable flow restriction includes a damping mechanism that urges the plurality of movable members towards the device inlet.

14. The system of claim 8, wherein the variable flow restriction includes a locking mechanism configured to lock the plurality of movable members in a locked position to provide a minimal flow restriction between the device inlet and the device outlet.

15. A method for providing a fluid flow within a wellbore, comprising:

providing the fluid flow to a device inlet of an pressure differential device having the device inlet and a device outlet;

moving a shaft having plurality of movable members between the device inlet and the device outlet, wherein the plurality of movable members are associated with a plurality of bores with each movable member being associated with a respective bore, wherein moving the shaft moves the plurality of movable members to alter a variable flow restriction between the device inlet and the device outlet to provide a predetermined constant pressure drop between the device inlet and the device outlet in response to a range of fluid flow rates at the device inlet, wherein each bore provides a different pressure drop, and a primary pressure drop occurs at the movable member having a smallest difference between an outside diameter of the movable member and its respective bore outlet due to a position of the shaft; and providing the fluid flow to the wellbore from the device outlet.

16. The method of claim 15, further comprising creating a plurality of associated flow restrictions configured to restrict the fluid flow with the plurality of movable members.

17. The method of claim 16, further comprising providing a target pressure drop via each of the plurality of associated flow restrictions in response to each of a plurality of discrete fluid flow rates.

* * * * *